US008851361B2

(12) United States Patent
Daley et al.

(10) Patent No.: US 8,851,361 B2
(45) Date of Patent: Oct. 7, 2014

(54) CONTAINER, BLANK, MANDREL AND METHOD OF FORMING THE CONTAINER

(75) Inventors: Michael Stephen Daley, Wantage Oxon (GB); John Kelly, Lincolnshire (GB); Ole Peter Trovaag, Heggedal (NO); Harald Harsson, Asker (NO); Ivica Franic, Vienna (AT)

(73) Assignee: Elopak Systems AG, Glattbrugg (CH)

( * ) Notice: Subject to any disclaimer, the term of this patent is extended or adjusted under 35 U.S.C. 154(b) by 1511 days.

(21) Appl. No.: 11/795,462

(22) PCT Filed: Jan. 30, 2006

(86) PCT No.: PCT/GB2006/000296

§ 371 (c)(1),
(2), (4) Date: Jun. 16, 2008

(87) PCT Pub. No.: WO2006/079834

PCT Pub. Date: Aug. 3, 2006

(65) Prior Publication Data

US 2008/0290146 A1 Nov. 27, 2008

(30) Foreign Application Priority Data

Jan. 29, 2005 (GB) ..... 0501887.4
Nov. 17, 2005 (GB) ..... 0523391.1

(51) Int. Cl.

| | |
|---|---|
| ***B65D 5/00*** | (2006.01) |
| ***B65D 5/08*** | (2006.01) |
| ***B65D 5/06*** | (2006.01) |
| ***B31B 3/00*** | (2006.01) |
| ***B31B 1/32*** | (2006.01) |

(52) U.S. Cl.

CPC . *B31B 3/00* (2013.01); *B65D 5/061* (2013.01); *B31B 2201/2604* (2013.01); *B31B 2201/2612* (2013.01); *B31B 1/32* (2013.01)

USPC ..... 229/137; 229/109; 229/184

(58) Field of Classification Search

USPC ..... 229/125.15, 125.42, 125.14, 214, 215, 229/248, 137, 184, 915.1, 138, 930, 213; 222/526, 528, 531, 535; 206/811; D9/696, 695, 699

See application file for complete search history.

(56) References Cited

U.S. PATENT DOCUMENTS

| | | | | |
|---|---|---|---|---|
| 4,192,446 | A * | 3/1980 | Naito | 229/137 |
| 4,869,372 | A * | 9/1989 | Wyberg | 229/249 |
| 5,636,785 | A * | 6/1997 | Kalberer et al. | 229/137 |
| 5,765,747 | A * | 6/1998 | Lawson | 229/125.15 |
| 5,803,349 | A * | 9/1998 | Ljungstrom | 229/137 |
| 5,845,840 | A * | 12/1998 | Johansson et al. | 229/104 |
| 6,019,279 | A * | 2/2000 | Tywoniuk | 229/137 |
| 2006/0144912 | A1 * | 7/2006 | Franic | 229/125.15 |

* cited by examiner

*Primary Examiner* — Gary Elkins
*Assistant Examiner* — Christopher Demeree
(74) *Attorney, Agent, or Firm* — Warn Partners, P.C.

(57) ABSTRACT

A blank (2) comprising a row of body panels (P1-P4), and a row of end closure panels (P6-P9) extending substantially parallelly to the row of body panels (P1-P4), whereof each end closure panel (P6-P9) has an edge (E1-E4), and whereof each of the second (P7) and fourth (P9) end closure panels has oblique lines of weakness (S1, S11, S2, S12) which divide its panel into a central sub-panel (P7*a*, P9*a*) adjacent the corresponding second or fourth body panel (P2, P4) and two end sub-panels (P7*b*, P7*c*, P9*b*, P9*c*) adjacent the corresponding edges (E2, E4), wherein the end sub-panels (P7*b*, P7*c*, P9*b*, P9*c*) bulge away from its corresponding edge (E2, E4). A container formed from the sheet material blank and a method of forming the container is also described. The method involves the use of a mandrel cap including a bearing surface (102) and a bridging surface portion (112) substantially flush with said bearing surface (102), and extending between recessed surface portions (104) at respective opposite sides of said bridging surface portion (112).

11 Claims, 12 Drawing Sheets

CONTAINER, BLANK, MANDREL AND METHOD OF FORMING THE CONTAINER

RELATED APPLICATIONS

Figure 1:
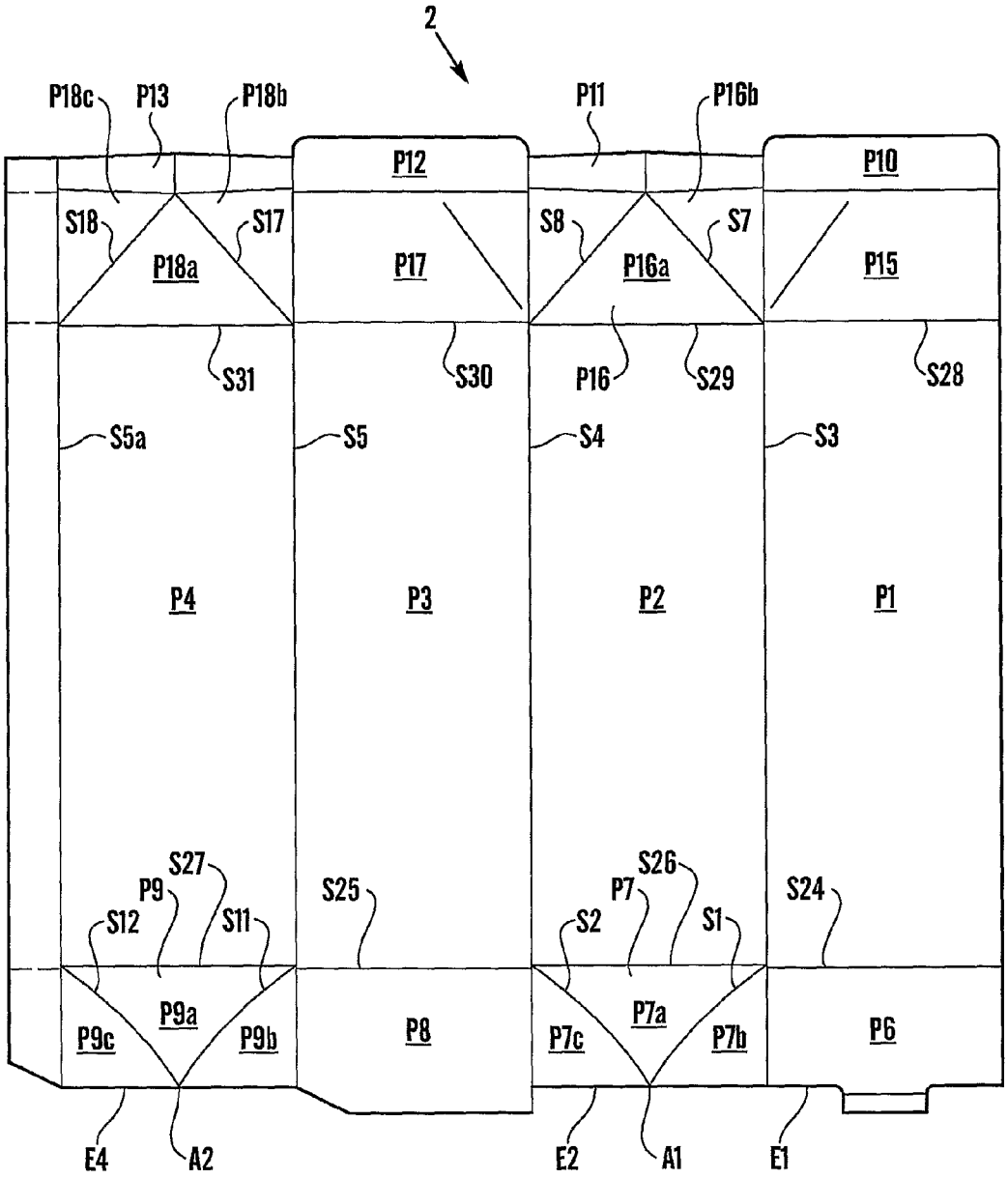

The present application is the U.S. national phase entry of PCT/GB2006/000296 with an international filing date of Jan. 30, 2006 and claims priority from Great Britain Patent Application Serial Nos. 0501887.4, filed Jan. 29, 2005 and 0523391.1, filed Nov. 17, 2005, which are incorporated by reference in their entirety.

This invention relates to sheet material blanks, containers formed therefrom, and to a method of forming a container.

According to a first aspect of the present invention, there is provided a sheet material blank comprised of a layer of cellulosic material and a layer of thermoplastics material, said blank comprising a row of body panels comprised of first, second, third and fourth body panels, and a row of end closure panels extending substantially parallelly to said row of body panels and comprised of first, second, third and fourth end closure panels, whereof each of the second and fourth end closure panels has first and second oblique lines of weakness which divide its panel into a central sub-panel adjacent the corresponding second or fourth body panel and two end sub-panels, each of said central sub-panels being substantially triangular and extending from a corresponding body panel to an apex and whereof the first end closure panel includes a central lug projecting centrally outwardly with respect to its panel, said central lug being separated from its panel by a line of weakness, wherein said line of weakness is off-set relative to an imaginary line passing through both of the apices and is at a level between an outermost edge of said first end closure panel and the level of said imaginary line.

According to a second aspect of the present invention, there is provided a container of sheet material comprised of a layer of cellulosic material and a layer of thermoplastics material, said container including a loop of body portions comprised of first, second, third and fourth body portions, an end closure including inner and outer, substantially rectangular wall portions extending from respective edges of the first and third body portions, with the outer portion overlapping the inner portion externally of said inner portion, and also including first and second groups of substantially triangular wall portions, the first and second groups of substantially triangular wall portions comprising respective inner, substantially triangular, wall portions extending from the second and fourth body portions, respectively, to respective apices adjacent each other, and respective pairs of outer, substantially triangular, wall portions extending from the respective inner, substantially triangular wall portions, and from the inner and outer, substantially rectangular, wall portions, the inner, substantially rectangular, wall portion including a lug projecting centrally with respect to the remainder of that wall portion and projecting portions at respective opposite sides of said lug which tuck between said outer, substantially rectangular wall portion and respective substantially triangular wall portions of the respective first and second groups of substantially triangular wall portions, said lug being folded back face-to-face upon said remainder and sandwiched between said remainder and said outer, substantially rectangular, wall portion, wherein said apices lie off a line along which said lug is folded back and are in contact with the inner wall portion.

Owing to these two aspects of the invention, it is possible to provide a container with an end closure of a "tuck" character in which the apices of the triangular wall portions are sealed against a flat surface, which reduces the likelihood of any of the cellulosic material at the apices being exposed to the contents of the container.

According to a third aspect of the present invention, there is provided a mandrel cap including a bearing surface for bearing against an end closure of a carton sleeve received on a mandrel, said bearing surface comprising first and second major surface portions at substantially the same level as each other, and a bridging surface portion substantially flush with said first and second major surface portions, and extending between recessed surface portions at respective opposite sides of said bridging surface portion.

According to a fourth aspect of the present invention, there is provided a method of forming an end closure of a carton sleeve comprising receiving a carton sleeve on a mandrel, said mandrel including a mandrel cap comprising a bearing surface having first and second major surface portions at substantially the same level as each other, and a bridging surface portion substantially flush with said first and second major surface portions, and recessed surface portions at respective opposite sides of said bridging surface portion, and pressing an end press against the outer surface of said end closure.

Owing to these two aspects of the invention, a mandrel cap can be provided so that in the forming of an end closure, the apices of the end closure are pressed sufficiently in order to reduce the likelihood of any of the cellulosic material at the apices being exposed to the contents of the container.

According to a fifth aspect of the present invention, there is provided a sheet material blank comprised of a layer of cellulosic material and a layer of thermoplastics material, said blank comprising a row of body panels comprised of first, second, third and fourth body panels, and a row of end closure panels extending substantially parallelly to said row of body panels and comprised of first, second, third and fourth end closure panels, whereof each end closure panel has an edge, and whereof each of the second and fourth end closure panels has first and second oblique lines of weakness which divide its panel into a central sub-panel adjacent the corresponding second or fourth body panel and two end sub-panels adjacent the corresponding edges, wherein said end sub-panels bulge away from its corresponding edge.

According to a sixth aspect of the present invention, there is provided a method of forming a container of sheet material, including providing an open container sleeve comprised of a layer of cellulosic material and a layer of thermoplastics material, said sleeve being comprised of body portions and end closure wall portions including first and second groups of substantially triangular end wall portions each including an inner, substantially triangular wall portion extending from a corresponding body portion to an apex, folding said end closure wall portions inwardly to form an end closure, and thereby causing each apex to direct away from the interior of said container sleeve towards said layer of thermoplastics material, and sealing said end closure by softening of thermoplastics material of said end closure.

Owing to these aspects of the invention, it is possible to reduce the likelihood of any of the cellulosic material at the apices being exposed to the contents of the container.

According to a seventh aspect of the present invention, there is provided a sheet material blank comprised of a layer of cellulosic material and a layer of thermoplastics material, said blank comprising a row of body panels comprised of first, second, third and fourth body panels, and a row of end closure panels extending substantially parallelly to said row of body panels and comprised of first, second, third and fourth end closure panels, whereof each of the second and fourth end closure panels has first and second oblique lines of weakness which divide its panel into a central sub-panel adjacent the corresponding second or fourth body panel and two end sub-panels, each of said central sub-panels being substantially triangular and extending from a corresponding body panel to an apex and whereof the first end closure panel comprises a sub-panel and a central lug projecting centrally outwardly with respect to the sub-panel, said central lug being separated from said sub-panel by a line of weakness, said line of weakness is off-set relative to an imaginary line passing through both apices and in a direction away from said first end closure panel, wherein said first end closure panel includes an edge including curved portions at respective opposite sides of said central lug.

According to an eighth aspect of the present invention, there is provided a container of sheet material comprised of a layer of cellulosic material and a layer of thermoplastics material, said container including a loop of body portions comprised of first, second, third and fourth body portions, an end closure including inner and outer, substantially rectangular wall portions extending from respective edges of the first and third body portions, with the outer portion overlapping the inner portion externally of said inner portion, and also including first and second groups of substantially triangular wall portions, the first and second groups of substantially triangular wall portions comprising respective inner, substantially triangular, wall portions extending from the second and fourth body portions, respectively, to respective apices adjacent each other, and respective pairs of outer, substantially triangular, wall portions extending from the respective inner, substantially triangular wall portions, and from the inner and outer, substantially rectangular, wall portions, the inner, substantially rectangular, wall portion having an edge and including a lug projecting centrally with respect to the remainder of that wall portion and folded back along a line of weakness face-to-face upon said remainder and sandwiched between said remainder and said outer, substantially rectangular, wall portion, said apices lie off said line of weakness and are in contact with the inner wall portion, wherein said edge includes curved portions at respective opposite sides of said lug.

Owing to these two aspects of the invention, the curved portions of the edge of the first end closure panel greatly reduce the risk of laminate material creasing or cracking when folding along the score line of the central lug.

In order that the invention be clearly and completely disclosed, reference will now be made, by way of example, with reference to the accompanying drawings, in which:—

Figure 3:
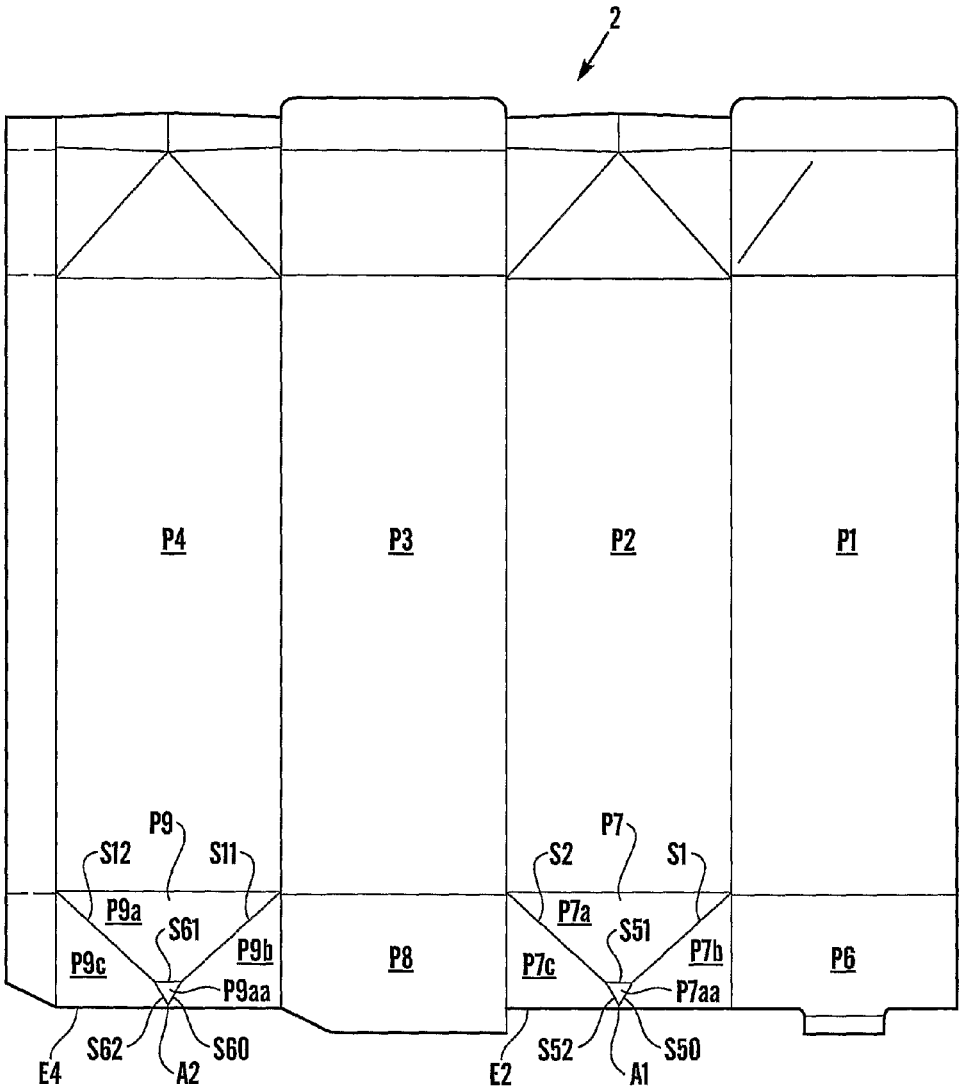
Figure 4:
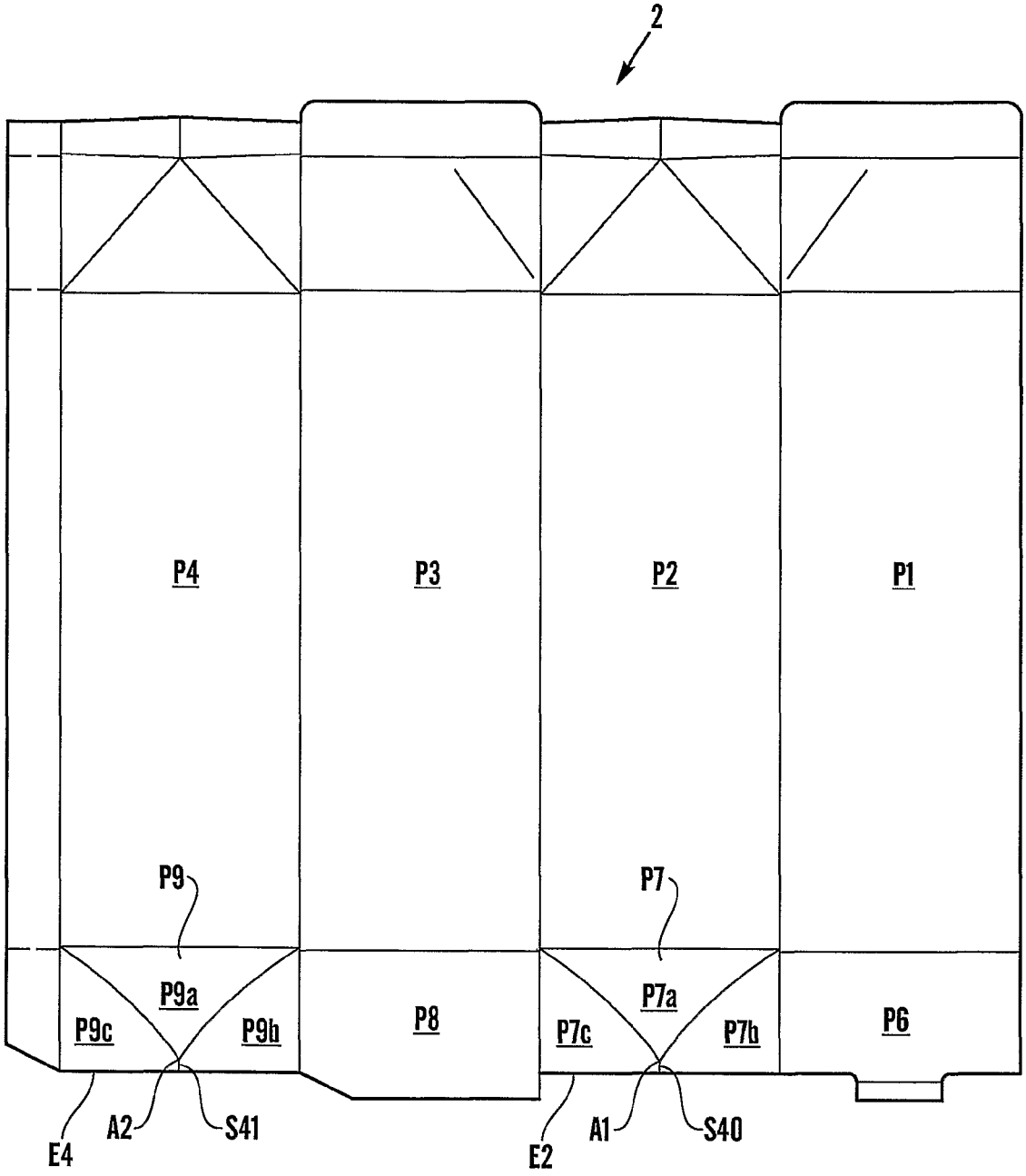
Figure 5:
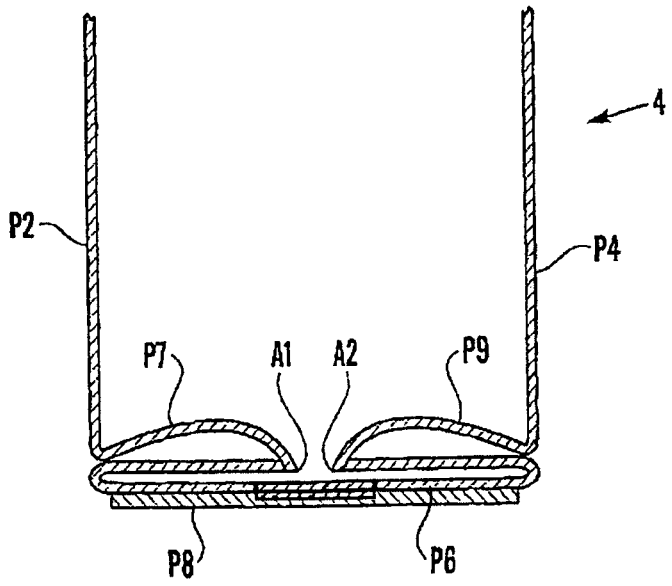
Figure 6:
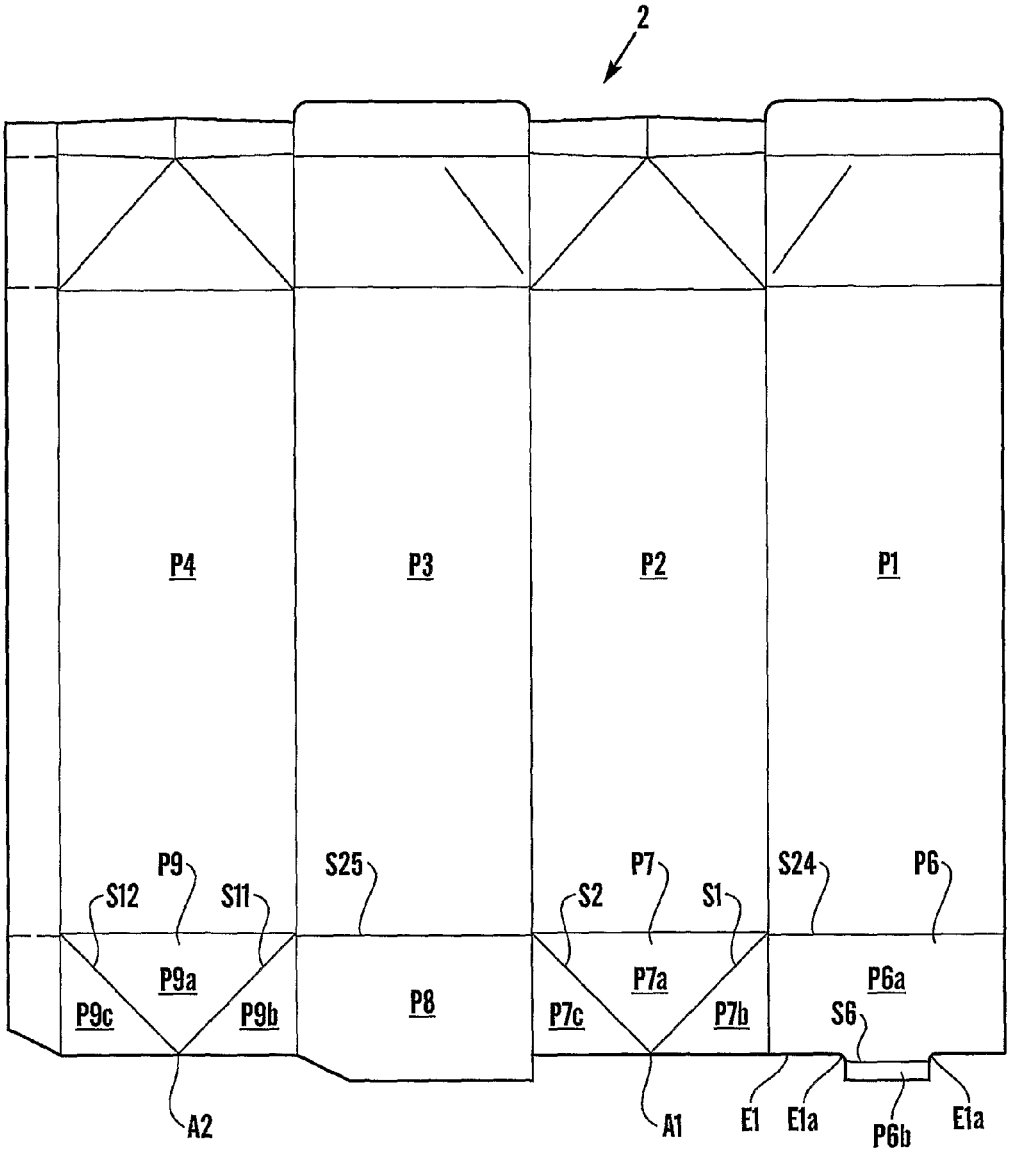
Figure 7:
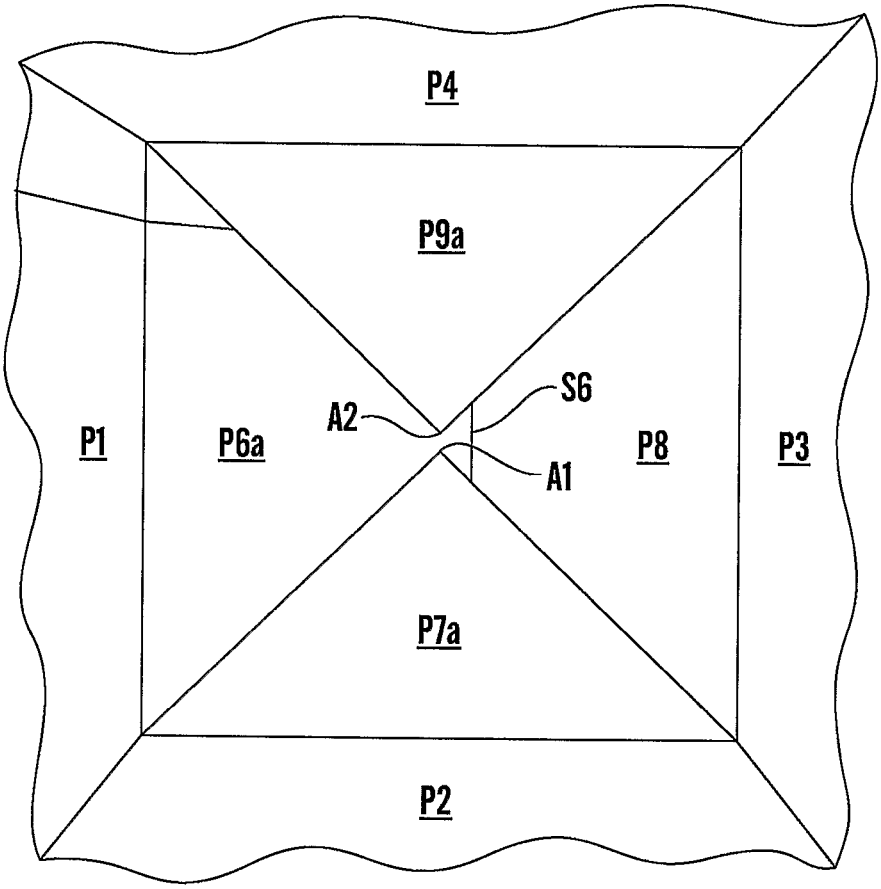
Figure 8:
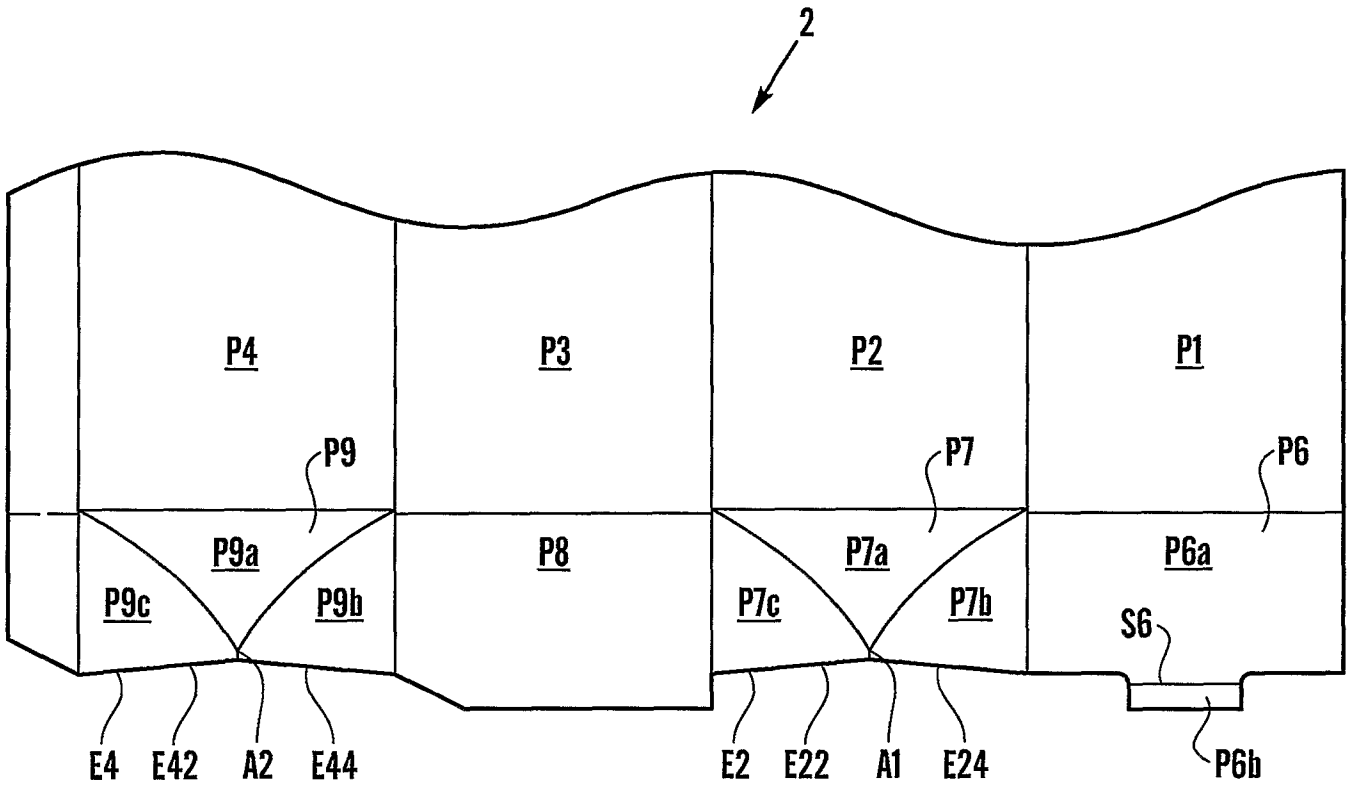
Figure 9:
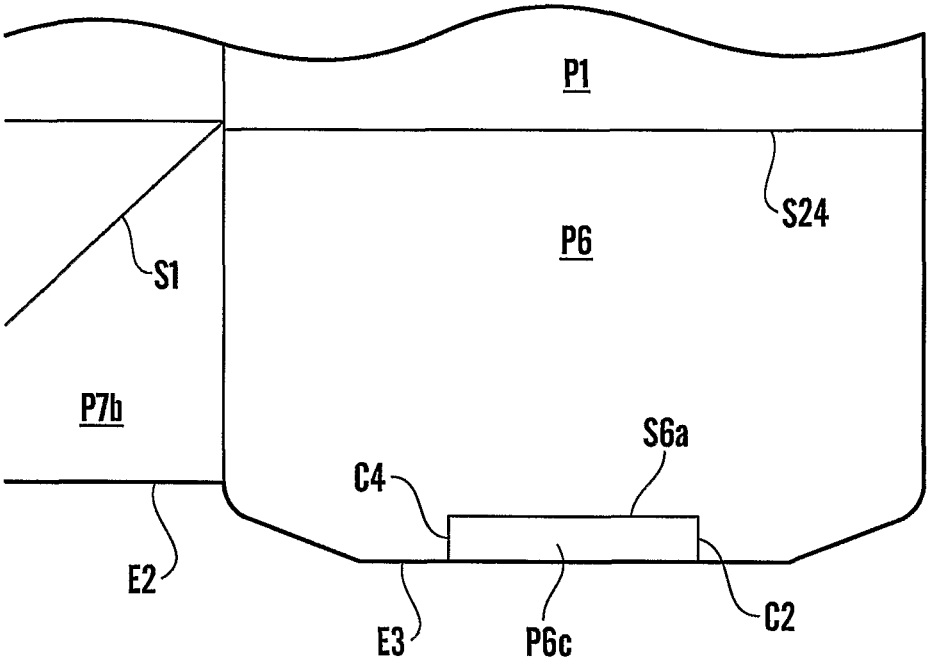
Figure 10:
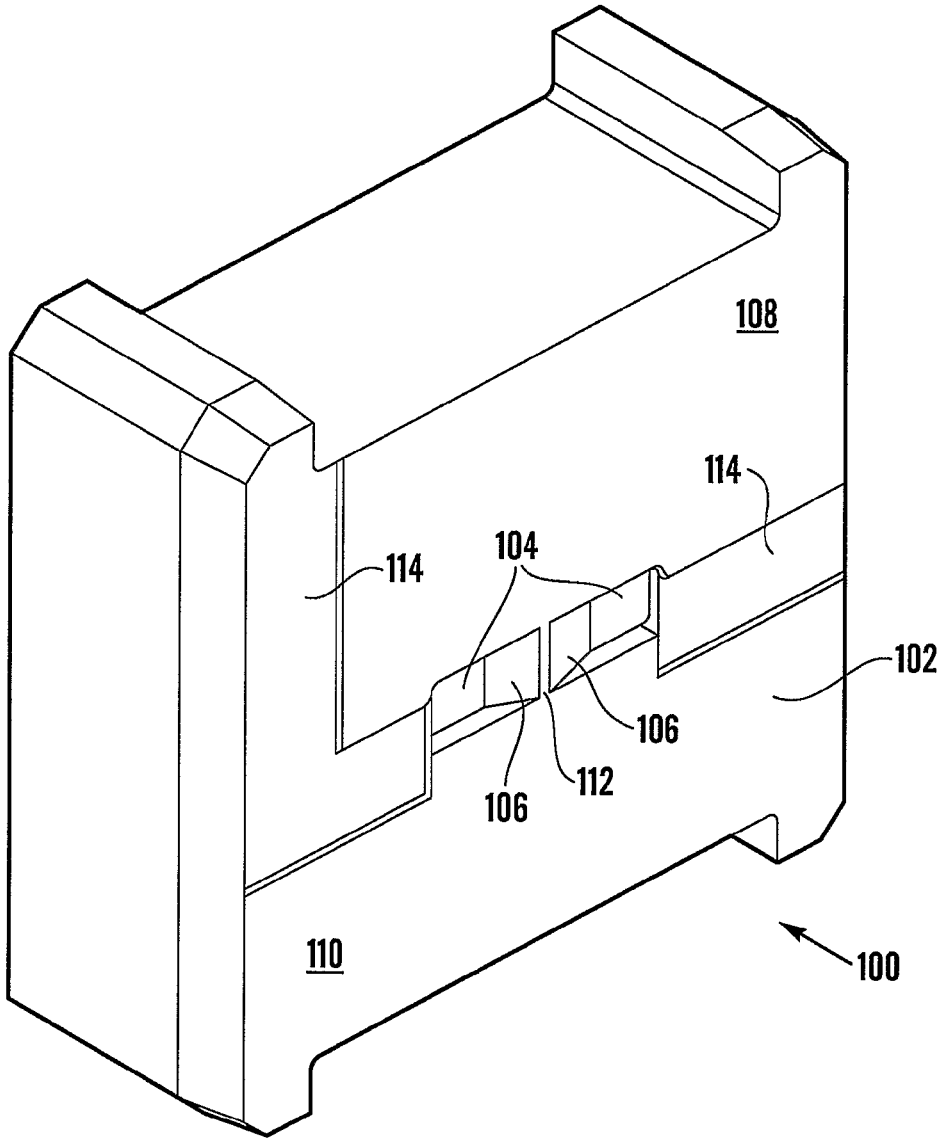
Figure 12:
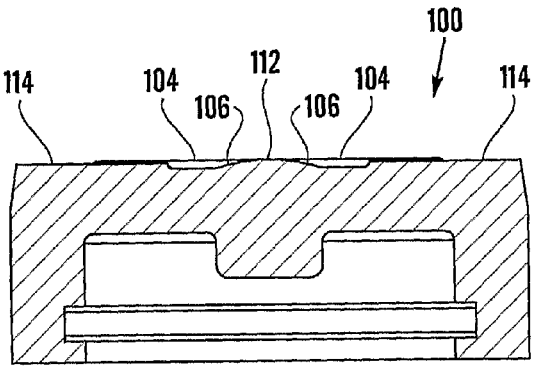
Figure 13:
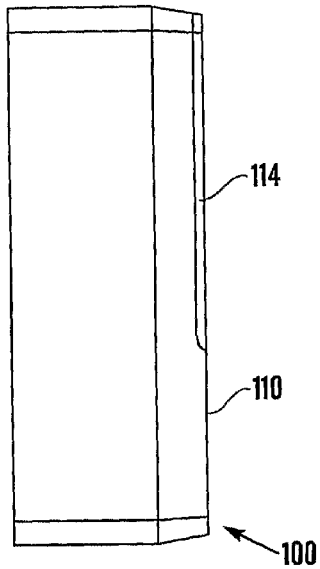
Figure 11:
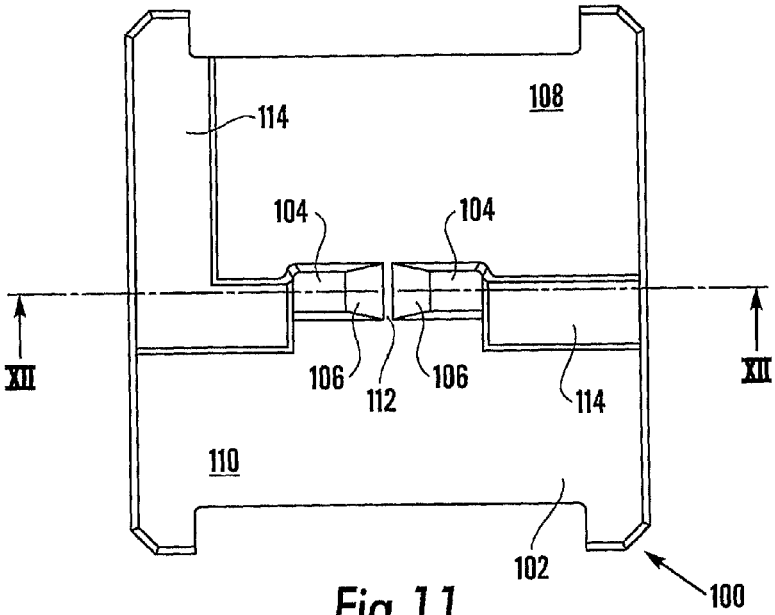
Figure 14:
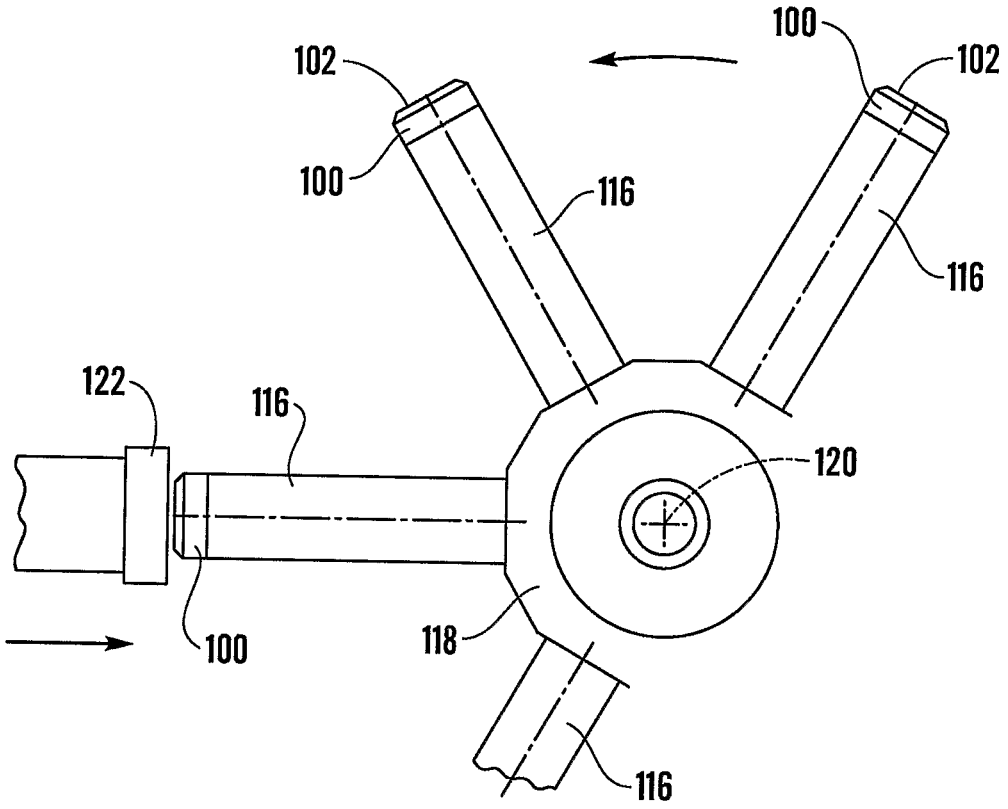

FIGS. 1 to 4 show respective versions of a container blank to be formed into a container, FIG. 5 is a partial vertical section of the container formed from the container blank shown in FIG. 1, FIG. 6 shows another version of a container blank to be formed into a container, FIG. 7 shows an internal view of an end closure of a container formed from the blank of FIG. 6, FIG. 8 shows part of a version of a container blank to be formed into a container, FIG. 9 shows part of a further version of a container blank to be formed into a container, FIG. 10 shows a perspective view of a mandrel cap for use in sealing a bottom end closure, FIG. 11 is a top plan view of the mandrel cap of FIG. 9, FIG. 12 is a cross section along the line XII-XII in FIG. 11, FIG. 13 is a side elevation of the mandrel cap of FIG. 9, and FIG. 14 is a fragmentary, diagrammatic, side elevation illustrating the co-operation between an end press and a plurality of mandrels each comprising the mandrel cap of FIG. 9.

Referring to FIGS. 1 to 5, the container blank 2 shown in FIG. 1 consists of a laminate consisting of at least a paperboard substrate layer and innermost and outermost layers of a moisture barrier thermoplastics (with the possible interposition of an oxygen barrier layer, e.g. aluminium foil, between the substrate and the innermost thermoplastics layer) and the container 4 formed therefrom (shown in FIG. 5) is used for packaging liquids, for example milk or fruit juice, and in particular the aseptic packaging of such liquids. The blank 2 consists of four body panels P1-P4 with a fifth standard sealing panel, bounded by lines of weakness in the form of score lines S3, S4, S5 and S5*a* there among.

The body panels P1 to P4 are bounded at their lower edges by further lines of weakness in the form of score lines S24 to S27 and thereby divided from a row of end closure panels P6 to P9. The end closure panels P6 and P8 and quadrangular and form respective, quadrangular, bottom panels of the gable-topped container 4, whilst the end closure panels P7 and P9 are quadrangular and each divided by score lines S1, S2, S11 and S12 which are curved so as to bulge away from a bottom edge E2 and E4.

The end closure panels P7 and P9 are divided into three substantially triangular sub-panels P7*a* to P7*c* and P9*a* to P9*c*, the central sub-panels P7*a* and P9*a* respectively extending from the body panels P2 and P4 to respective apices A1 and A2 adjacent the bottom edges E2 and E4.

The row of body panels P1 to P4 are bounded at their upper edges by further lines of weakness in the form of score lines S28 to S31 and thereby divided from a row of top obturating panels P15 to P18. The panels P15 and P17 are quadrangular and form respective quadrangular roof panels of the gable-topped container 4, whilst the panels P16 and P18 are quadrangular and each divided by respective straight score lines S7, S8, S17 and S18 into three triangular sub-panels P16*a* to P16*c* and P18*a* to P18*c*.

The row of top obturating panels P15 to P18 are bounded at their upper edges by a row of top-sealing panels P10 to P13 to form a sealing fin of the carton 4.

The end closure panels P6 to P9 are folded to form an end closure, as can be seen in section in FIG. 5. The end closure panels P7 and P9 are folded along the score lines S1, S2, S11 and S12 in such a way that each of the apices A1 and A2 is caused to direct away from the interior of the container 4. The score lines S1, S2, S11 and S12 are curved in a manner that encourages the apices A1 and A2 to curve downwards towards the quadrangular end closure panel P6, once the folding of the end closure panels P6 to P9 takes place.

The directing of the apices A1 and A2 away from the interior of the container 4 is to reduce the likelihood of the ultimate contents of the container 4 contacting the paperboard layer of the laminate that forms the walls of the container 4. When the end panels P7 and P9 are folded to form the apices A1 and A2, the paperboard layer in the laminate material is exposed at each of those apices A1 and A2. The curving of the score lines S1, S2, S11 and S12 causes the apices A1 and A2 to point downwards.

Following the folding of the end closure panels P6 to P9, these panels are sealed to form a bottom closure. The sealing comprises heating and pressing together the panels P6 to P9 to render the thermoplastics tacky in order to create a sealed bottom closure. This process is described in further detail with reference to FIGS. 9 to 13. The apices A1 and A2 are pressed and sealed against a tacky thermoplastics layer of the end closure panel P6, thereby reducing the likelihood that the paperboard exposed at the apices A1 and A2 is later exposed to the ultimate contents of the container 4. In particular, it is intended that the tacky thermoplastics immediately above the paperboard at each apex should contact the tacky thermoplastics layer of the end closure panel P6 either before or at the same time as the paperboard at the apex touches that thermoplastics layer. This intention also applies to the versions of FIGS. 2 to 4 to be described.

Figure 2:
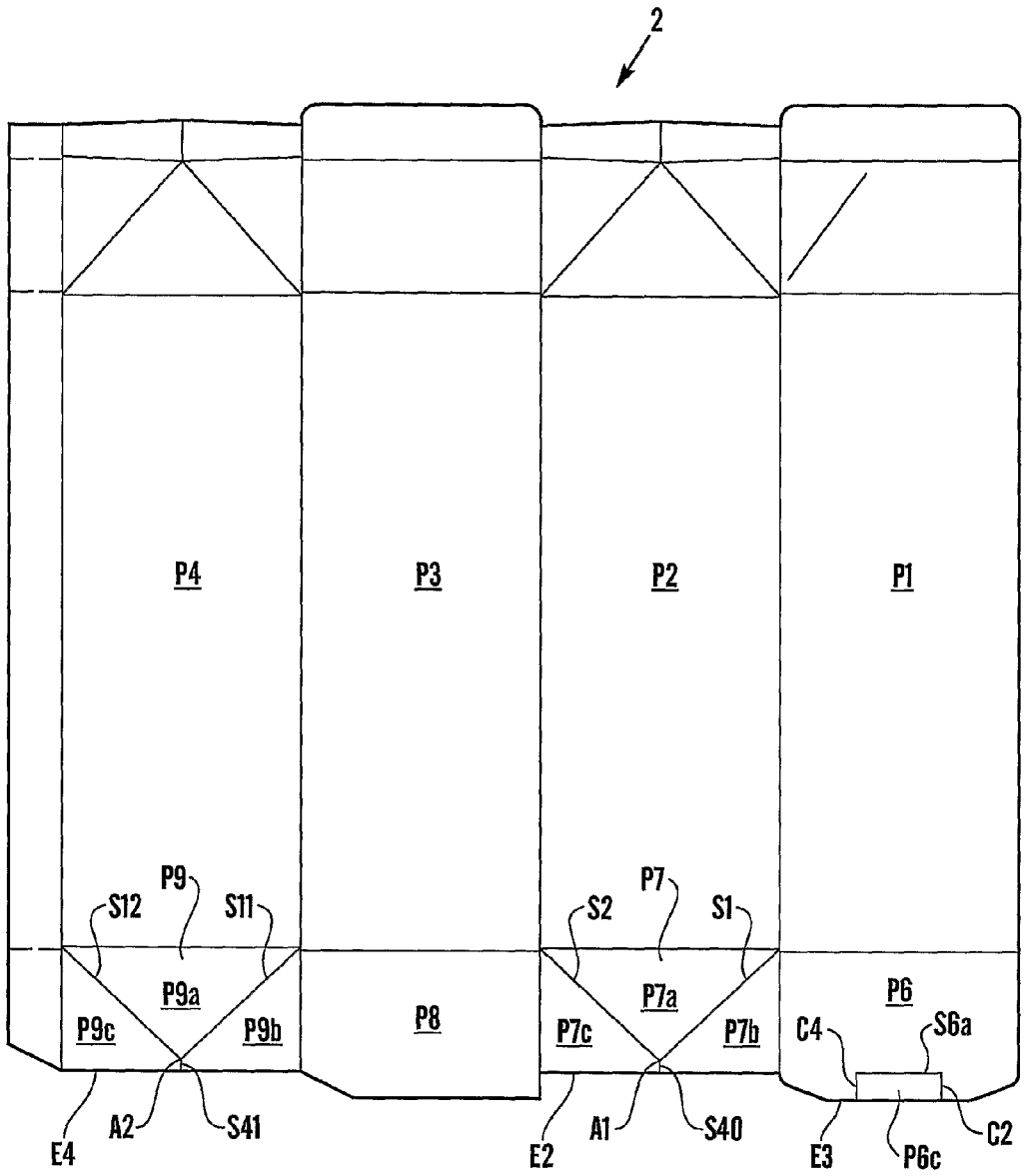

The version of FIG. 2 differs from that of FIG. 1 in that the end sub-panels P7*b*, P7*c*, P9*b* and P9*c* are defined by score lines S1, S2, S11 and S12 and additionally by score line S40 and S41. The end sub-panels P7*b*, P7*c*, P9*b* and P9*c* nevertheless bulge away from the bottom edge E2 and E4. The angle of the score lines S1, S2, S11 and S12 relative to the score lines S26 and S27 is 43 degrees rather than the 45 degrees of a conventional bottom closure.

The score lines S40 and S41 join respective apices A1 and A2 to the edges E2 and E4, and when the end closure panels P6 to P9 are folded to create the bottom closure of the container 4, a pinch of laminate is provided from each apex A1 and A2 that turns downwards away from the ultimate contents of the container 4. As in the version of FIG. 1, the paperboard at the apices A1 and A2 is more likely to be sealed away from the ultimate contents of the container 4.

When the bottom closure of the version of FIG. 2 is heated and pressed to form the sealed bottom closure, the downward pinch of material is sealed to the end closure panel P6, with the thermoplastics layer of the laminate creating seals at the apices A1 and A2.

A third version is shown in FIG. 3. In this version the panels P7 and P9 are each divided by five score lines S1, S2, S50, S51 and S52 (for P7) and S11, S12, S60, S61 and S62 (for P9). The score lines S50 to S52 and S60 to S62 respectively define substantially triangular sub-sub-panels P7*aa* and P9*aa* of the central sub-panels P7*a* and P9*a*. The score lines S51 and S61 bisect the panels P7 and P9 respectively.

In this version, the end sub-panels P7*b*, P7*c*, P9*b* and P9*c* are defined by the score lines S1 and S50 (P7*b*), S2 and S52 (P7*c*), S11 and S60 (P9*b*), and S12 and S62 (P9*c*). The end sub-panels P7*b*, P7*c*, P9*b* and P9*c* bulge away from the edges E2 and E4. The bulge in the end sub-panels P7*b*, P7*c*, P9*b* and P9*c* is created by an angle of slightly less than 180 degrees about a flexion point between the score lines S1 and S50 (P7*b*), S2 and S52 (P7*c*), S1 and S60 (P9*b*), and S12 and S62 (P9*c*). The bisecting line of weakness S51 and S61 run between those flexion points.

When the end panels P6 to P9 are folded to create the end closure of the container 4, then, in a similar manner to the version of FIG. 1, the apices A1 and A2 are directed away from the interior of the container 4. Bending occurs along the score lines S51 and S61 to assist the downwards direction of the apices A1 and A2. When the end closure panels P6 to P9 are sealed, then the apices A1 and A2 are sealed to the panel P6, with the thermoplastics layer of the laminate creating a seals at the apices A1 and A2.

FIG. 4 illustrates a fourth version of the container blank 2, which in respect of the panels P7 and P9, is a combination of the features of FIGS. 1 and 2. The score lines S1, 82, S11 and S12 are curved, as in FIG. 1, but they terminate a short distance from the edges E2 and E4, so that the apices A1 and A2 are separated from the edges E2 and E4, respectively, by a short score line S40 and S41, as in FIG. 2.

As before, when the end closure panels P6 to P9 are folded to create the bottom closure of the container 4, a pinch of laminate is provided from each apex A1 and A2 that turns downwards away from the ultimate contents of the container 4. The paperboard layer in the laminate at the apices A1 and A2 is more likely to be sealed away from the ultimate contents of the container 4.

The container blank 2 shown in FIG. 6 has end panels P7 and P9 divided by score lines S1, S2, S11 and S12 in a conventional configuration. The score lines S1, S2, S11 and S12 define three substantially triangular sub-panels P7*a* to P7*c*, and P9*a* to P9*c*.

The panel P6 is provided with a score line S6 which divides the panel P6 into a sub panel P6*a* and a central lug P6*b* projecting centrally outwardly from the panel P6, the central lug P6*b* being separated from the sub-panel P6*a* by a score line S6 which lies off an imaginary line passing through the apices A1 and A2 of the sub-panels P7*a* and P9*a* and in a direction away from the panel P6. The edge E1 includes curved portions E1*a* at respective opposite sides of the lug including the sub-panel P6*b*, so as to promote folding at the score line S6 as opposed to folding of the lug at the imaginary line mentioned above, which would be more likely to occur if the curved edge portions E1*a* were to be replaced by rectangular portions, which would otherwise be expected. It will be noted that the same feature is present in the versions of FIGS. 1, 3 and 4.

Referring to FIG. 7 when the blank 2 of FIG. 6 is folded, the substantially triangular sub-panels P7*a* to P7*c* and P9*a* to P9*c* are inwardly folded with the sub-panel P7*a* and P9*a* located above the sub-panels P7*b* and P7*c*, and P9*b* and P9*c* thereof, with the substantially rectangular end closure panel P6, with its lug P6*b* folded back and with the substantially rectangular end closure panel P8 folded onto the end closure panel P6 with the folded back lug P6*b* located between them.

The score line S6 is located so as to provide an extension of the surface of the end closure panel P6*a* to which the apices A1 and A2 are to be sealed. This ensures that the apices A1 and A2 are sealed onto a flat surface rather than a step formed by the folding back of the lug P6*b* if the score line S6 were to lie on the imaginary line passing through each of the apices A1 and A2, as is conventional. This also ensures that the apices A1 and A2 are sealed onto a higher flat surface with respect to the inside of the container rather than a lower flat surface formed by the folding back of the lug P6*b* if the score line S6 were to lie on the opposite side of the imaginary line passing through each of the apices A1 and A2, as is also conventional.

FIG. 8 illustrates a further version of the container blank 2, which is similar to the version shown in FIG. 4. The score lines S1, S2, S11 and S12 are curved, but they terminate a short distance from the edges E2 and E4, so that the apices A1 and A2 are separated from the edges E2 and E4, by a short gap, (unlike the version of FIG. 4, where the apices A1 and A2 are separated from the edges E2 and E4 by a short score line S40 and S41).

As before, when the end closure panels P6 to P9 are folded to create the bottom closure of the container 4, a pinch of laminate is provided from each apex A1 and A2 that turns downwards away from the ultimate contents of the container 4. The paperboard layer in the laminate at the apices A1 and A2 is more likely to be sealed away from the ultimate contents of the container 4.

In the version of the container blank 2 shown in FIG. 8, the edges E2 and E4 are each comprised of two oblique portions E22, E24 and E42, E44 so as to form a slight upward pitch. The edge portions E22, E24 and E42, E44 extend outwardly and downwardly from a central point of the edges E2 and E4 closest to the respective apices A1 and A2.

Preferably, the size of the gap between the central points of the edges E2 and E4 and the respective apices A1 and A2 is between 0.8 mm and 1.4 mm for a one liter container. In addition, the distance between the central points of the edges E2 and E4 and an imaginary horizontal line joining the two outer ends of the edges E2 and E4 is preferably 0.8 mm, on the same container.

Referring to FIGS. 2 and 9, the version of the container blank 2 shown has a "tuck" end closure arrangement (the word "tuck" referring to the manner in which the end closure panel P6 tucks between the end closure panel P8 and the substantially triangular sub-panels P7*c* and P9*b* when the end closure is formed; as opposed to a "non-tuck" arrangement as shown in FIGS. 1 and 3 to 8). In FIG. 2 a centrally located lug P6*c* is formed within the boundaries of the panel P6 by a pair of substantially parallel cuts C2 and C4 extending inwardly from an outermost lower edge E3 of the end closure panel P6 and a score line S6*a* joining the upper ends of the cuts C2 and C4, the score line S6*a* being at a level between the lower edge E3 and the level of an imaginary line passing through both Apices A1 and A2.

The version shown in FIG. 9 differs to that of the arrangement of FIG. 2 in that the score line S6*a* is located nearer the lower edge E3 and could therefore be applicable to container blanks where the apices A1 and A2 are at the edges E2 and E4. The preferred distance from the edge E3 in FIG. 9 to the level of the score line S6*a* is between substantially 3 mm. and substantially 6 mm. (that is substantially 42% to substantially 84% of the distance between the lower edge (E3) and the imaginary line passing through both apices) and most preferably around 4.50 mm. (that is substantially 63% of the distance between the lower edge (E3) and the imaginary line passing through both apices). In a standard end closure arrangement of this "tuck" character, the score line of the central lug (which is at the level of an imaginary score line passing through both apices) is around 7.11 mm. from the outermost lower edge. Once the end closure is formed, the arrangement of the panels would be similar to that shown in FIG. 7. When the container is formed, the apices A1 and A2 are sealed at a location where a multiplicity of layers of the laminate are arranged one on top of the other so that an efficient sealing force can be created between the mandrel end cap and the end press.

A disadvantage of a standard end closure arrangement of this type is that, sometimes, when the container is formed, the apices A1 and A2 (when adjacent their respective edges E2 and E4) are sealed directly onto a fold formed by the folding back of the lug along the score line, or worse still sealed on to the inner surface of the outer end closure panel P8, thereby producing an insufficient seal. If the apices are sealed against the end closure panel P8 there is only one layer of laminate between an end cap of the mandrel on which the container will be partially formed and an end press.

Referring to FIGS. 10 to 13, a mandrel cap 100 fixed to an end of a mandrel (as shown in FIG. 14) includes a bearing surface 102 for bearing against the end closure of a carton sleeve, the bearing surface 102 comprising recessed surface portions 104 and ramped surface portions 106 leading to the recessed surface portions 104. The ramped surface portions 106 can be cambered, convex, concave, planar or comprise a series of steps.

The bearing surface 102 also comprises first and second major surface portions 108 and 110 at substantially the same level as each other, and a bridging surface portion 112 substantially flush with the first and second major surface portions 108 and 110, with the recessed surface portions 104 at respective opposite sides of the bridging surface portion 112. The bridging surface portion 112 is of a relatively small surface area and joins together the first and second major surface portions 108 and 110. The mandrel cap 100 also includes further recess portions 114 to accommodate those parts of the end closure that include a further layer of paperboard.

The first and second major surfaces 108 and 110 form the outermost surfaces of the bearing surface 102 of the mandrel cap 100, the recessed surface portions 104 form the innermost surfaces of the bearing surface 102 of the mandrel cap 100, and the further recess portions 114 are intermediate the outermost and innermost surfaces.

Referring to FIG. 14, a plurality of mandrels 116, including respective, changeable mandrel caps 100, with bearing surfaces 102, are fixed to a rotary hub 118 which is rotated stepwise about its own axis 120. The mandrels 116 are equiangularly spaced about, at various stations (not illustrated), about the axis 120, the mandrels 116 in turn receive carton sleeves each open at both ends; the sleeves in turn have bottom end closure panels folded-in to the condition shown in FIG. 5; in turn have a hot end press 122 applied to the outer surface of the end closures, to heat- and pressure-seal the end closure panels together; the sealed bottom end closures are cooled by the mandrels 116 and in turn the carton sleeves, now closed at one end, are removed from the mandrels 116.

During the folding, pressing and sealing process, the recess surface portions 104, the ramp surface portions 106 and the bridging surface portion 112 play an important role in ensuring the apices A1 and A2 (see FIG. 5) are correctly sealed. The width of the bridging surface portion 112 which is the distance between each of the ramp surface portions 106 is a minimum of 3 mm, but preferably 5 mm. As the end press presses the end closure against the mandrel cap 100, the ramp surface portions 106 and the bridging surface portion 112 engage the apices A1 and A2 and the bridging surface portion 112 is narrow to ensure that the majority of pressure created in the pressing operation is at a central location over the apices.

Although all of the versions described with reference to the drawings have their inner, substantially rectangular, end closure panels (P6; P6*a*) provided with outwardly turned lugs (P6*b*,P6*c*), the present invention is applicable to other styles of end closure. It is particularly applicable to aseptic packaging, especially for long-life low-acid products, where it is important to prevent micro-organisms, if any, present in the paperboard from having access to the product in the container.

Again, although all of those versions described with reference to the drawings are designed to provide gable tops, it will be understood that they could be designed so as instead to provide slant tops or flat tops.

The invention claimed is:

1. A sheet material blank comprised of a layer of cellulosic material and a layer of thermoplastics material, said blank comprising a row of body panels comprised of first, second, third and fourth body panels, and a row of bottomend closure panels extending substantially parallelly to said row of body panels and comprised of first, second, third and fourth bottomend closure panels, whereof each end closure panel has a free edge, and whereof each of the second and fourth end closure panels has first and second oblique lines of weakness which divide its panel into a central sub-panel adjacent the corresponding second or fourth body panel and two end sub-panels adjacent the corresponding free edges, wherein said first and second oblique lines of weakness partly defining said end sub-panels and bulge away from its corresponding free edge.

2. A sheet material blank according to claim 1, wherein said first and second oblique lines of weakness are curved.

3. A sheet material blank according to claim 1, wherein said first and second oblique lines of weakness are each formed by two rectilinear sub-lines of weakness which meet at a flexion point intermediate said free edge and a line of weakness between said central sub-panel and its adjacent body panel.

4. A sheet material blank according to claim 1 wherein said second and fourth end closure panels include first and second groups of substantially triangular end wall portions each including an inner, substantially triangular wall portion extending from a corresponding body portion to an apex, the apices being spaced from its closest free edge.

5. A sheet material blank according to claim 4, and further comprising a line of weakness joining the apex to its closest free edge.

6. A sheet material blank according to claim 4, whereof the first end closure panel comprises a sub-panel and a central lug projecting centrally outwardly with respect to the sub-panel, said central lug being separated from said sub-panel by a line of weakness, wherein said line of weakness is off-set relative to an imaginary line passing through both apices and in a direction away from said first end closure panel.

7. A sheet material blank according to claim 4, whereof the first end closure panel comprises a central lug projecting centrally outwardly with respect to that panel, said central lug being separated from that panel by a line of weakness, wherein said line of weakness is off-set relative to an imaginary line passing through both apices and at a level between a lower edge of that panel and substantially the level of said imaginary line.

8. A sheet material blank according to claim 1, wherein the free edges of said second and fourth end closure panels each comprise two oblique portions so as to form a slight upward pitch.

9. A sheet material blank according to claim 8 wherein said second and fourth end closure panels include first and second groups of substantially triangular end wall portions each including an inner, substantially triangular wall portion extending from a corresponding body portion to an apex, the apices being spaced from its closest edge and said oblique portions extend outwardly and downwardly from a central point of the edges of said second and fourth end closure panels closest to the respective apices.

10. A sheet material blank comprised of a layer of cellulosic material and a layer of thermoplastics material, said blank comprising a row of body panels comprised of first, second, third and fourth body panels, and a row of bottomend closure panels extending substantially parallelly to said row of body panels and comprised of first, second, third and fourth bottomend closure panels, whereof each of the second and fourth end closure panels has first and second oblique lines of weakness which divide its panel into a central sub-panel adjacent the corresponding second or fourth body panel and two end sub-panels, each of said central sub-panels being substantially triangular and extending from a corresponding body panel to an apex and whereof the first end closure panel comprises a sub-panel and a central lug projecting centrally outwardly with respect to the sub-panel, said central lug being separated from said sub-panel by a line of weakness, said line of weakness is off-set relative to an imaginary rectilinear line passing through both apices and in a direction away from said first end closure panel, wherein said first end closure panel includes an edge including inwardly curved portions at respective opposite edges of said central lug.

11. A container of sheet material comprised of a layer of cellulosic material and a layer of thermoplastics material, said container including a loop of body portions comprised of first, second, third and fourth body portions, a bottom end closure including inner and outer, substantially rectangular wall portions extending from respective edges of the first and third body portions, with the outer portion overlapping the inner portion externally of said inner portion, and also including first and second groups of substantially triangular wall portions, the first and second groups of substantially triangular wall portions comprising respective inner, substantially triangular, wall portions extending from the second and fourth body portions, respectively, to respective apices adjacent each other, and respective pairs of outer, substantially triangular, wall portions extending from the respective inner, substantially triangular wall portions, and from the inner and outer, substantially rectangular, wall portions, the inner, substantially rectangular, wall portion having an edge and including a lug projecting centrally with respect to the remainder of that wall portion and folded back along a line of weakness face-to-face upon said remainder and sandwiched between said remainder and said outer, substantially rectangular, wall portion, said apices lie away from said line of weakness and are in contact with the inner wall portion, wherein said edge includes inwardly curved portions at respective opposite edges of said lug.

* * * * *